United States Patent [19]

Wood

[11] 4,169,402

[45] Oct. 2, 1979

[54] ISOLATED GUITAR BODY

[76] Inventor: Neil L. Wood, 1800 N. Lincoln Ave., Chicago, Ill. 60614

[21] Appl. No.: 823,105

[22] Filed: Feb. 6, 1978

[51] Int. Cl.[2] ..... G10D 1/08; G10D 3/12

[52] U.S. Cl. ..... 84/291; 84/293; 84/299; 84/307; 84/314 R

[58] Field of Search ..... 84/267, 278, 280, 281, 84/290, 291, 293, 298, 299, 307, 314

[56] References Cited

U.S. PATENT DOCUMENTS

| | | | |
|---|---|---|---|
| 1,337,459 | 4/1920 | Lappalainen | 84/280 |
| 1,635,429 | 7/1927 | Miller | 84/274 |
| 2,113,446 | 4/1938 | Gugino | 84/274 |
| 3,538,807 | 11/1970 | Francis | 84/293 X |
| 4,037,815 | 7/1977 | De Lano | 84/327 X |

FOREIGN PATENT DOCUMENTS

| | | | |
|---|---|---|---|
| 399869 | 8/1924 | Fed. Rep. of Germany | 84/274 |

*Primary Examiner*—Lawrence R. Franklin

[57] ABSTRACT

A frame in which the body of a string instrument is supported, the frame having a main bar extending longitudinally in spaced relation to the back of the instrument body. The frame extends with end-pieces adapting to the ends of the said body, such end-pieces having clips applicable to the said ends by way of semi-hard inserts to dispose the body floatingly. One end-piece also extends with the neck and fret or string board of the instrument, while the other end-piece returns with a tail piece receiving the inner ends of the strings and formed as a bridge. The main bar is longitudinally adjustable for different lengths of instrument bodies.

6 Claims, 5 Drawing Figures

ISOLATED GUITAR BODY

My invention relates to string instruments, and more particularly to guitars. As guitars are constructed, the body is the sound chamber; and its vibrations reflect and amplify the sounds produced by the strings. It is therefore desirable that the vibrations be created in as many areas of the body as possible in order to obtain the best volume and richest sound from the instrument. However, I have found that the sound board of the instrument body, made solid by inner bracing, loses vibrations over a considerable area for that reason, and therefore transmits less sound to the tone chamber. As generally constructed the bridge is where the vibrations of the strings are absorbed and transmitted to the sound board of the guitar body. The bridge is usually a flat bar attached to the sound board of the guitar body and formed with receptacles for the inner ends of the strings. Obviously, the inner bracing stiffens the sound board over a substantial area, excluding vibrations from the same. Also, securing the inner ends of the strings in an area where the instrument sound board is not rigid but yieldable to vibrations imposes a strong pull and a strain on such sound board in a direction crosswise of the flow of vibrations from the strings toward the sound chamber, tending to deflect and dissipate such vibrations.

In view of the above situation, it is a primary object of the present invention to eliminate the inner bracing and foot and end blocks as part of the instrument body, and free the latter for the direct passage of sound vibrations from the strings to the sound chamber.

A further object is to provide a bridge as an element supported outside the instrument body, yet engaging the sound board thereof along a thin line where it can transmit the vibrations from the strings to the best advantage.

Another object is to design the bridge as a part of a frame in which the instrument body is secured, the frame being rigid for the most part, resistant to the strongest pull of the strings, and not in the least damping or dispelling the sound vibrations passing from the strings to the sound chamber.

A further object is to design a frame of the character mentioned which suspends the body of the instrument floatingly, in order that it may be free to emit all the tone values it is capable of producing.

A still further object is to combine the frame with the fret or string board by casting it integral with the neck and head thereof.

A final object is to construct the novel frame mostly of light but rigid metal, and in a manner adjustable to fit the types and sizes of instruments for which it is intended without difficulty.

A better understanding of the invention may be gained by reference to the accompanying drawing, in which FIG. 1 is a perspective rear view of a guitar showing the novel frame attached to its body portion and fret board;

Figure 1:
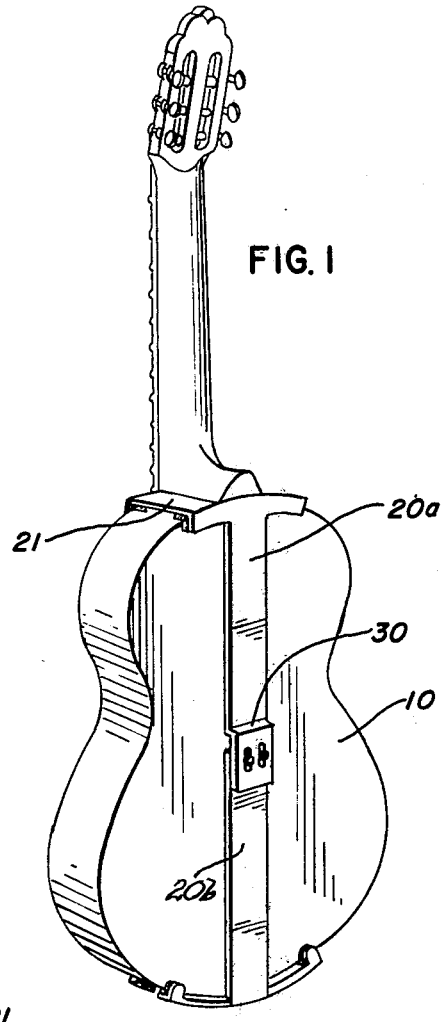
Figure 2:
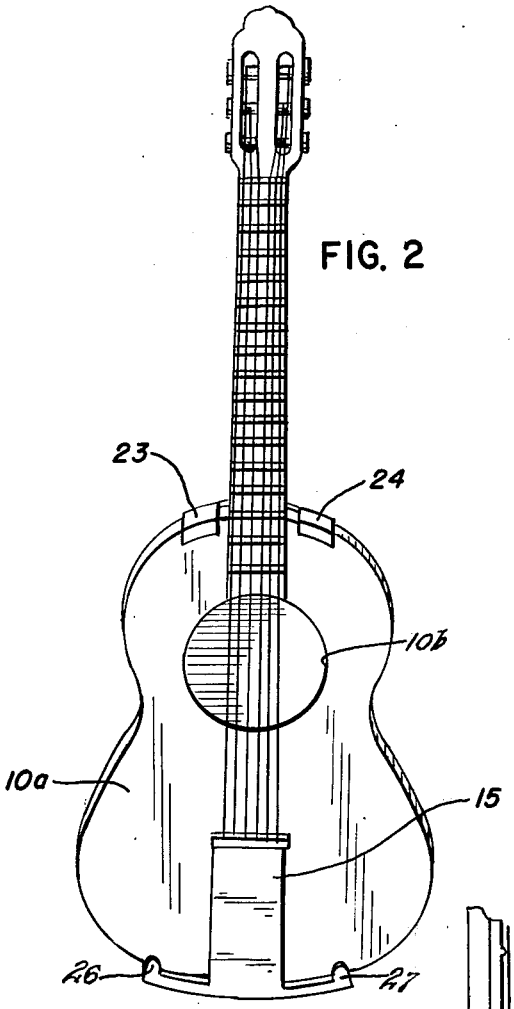
FIG. 2 is a front elevation of the guitar in upright position as equipped with the frame.
Figure 3:
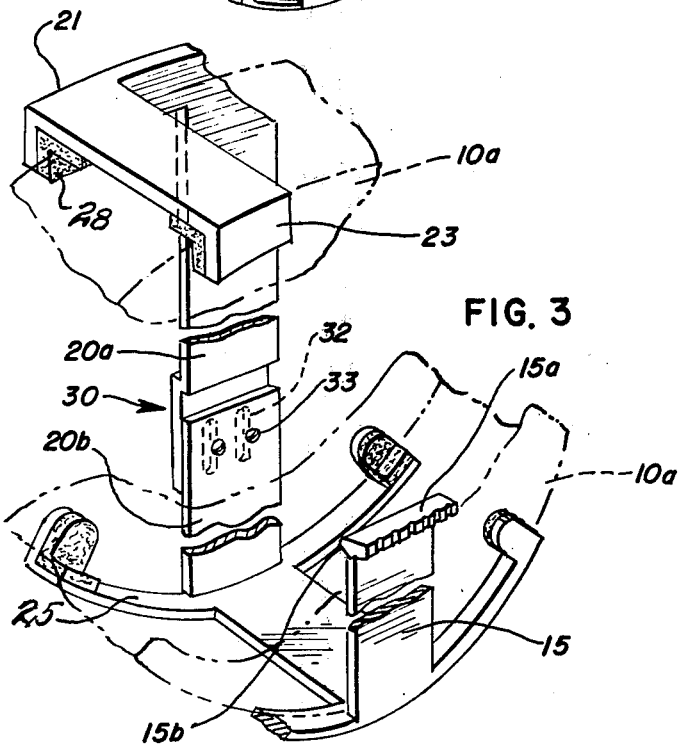
FIG. 3 is an enlarged perspective view of the frame as seen in FIG. 1, but broken away at medial points, the end portions of the guitar body being indicated by dotted lines.
Figure 4:
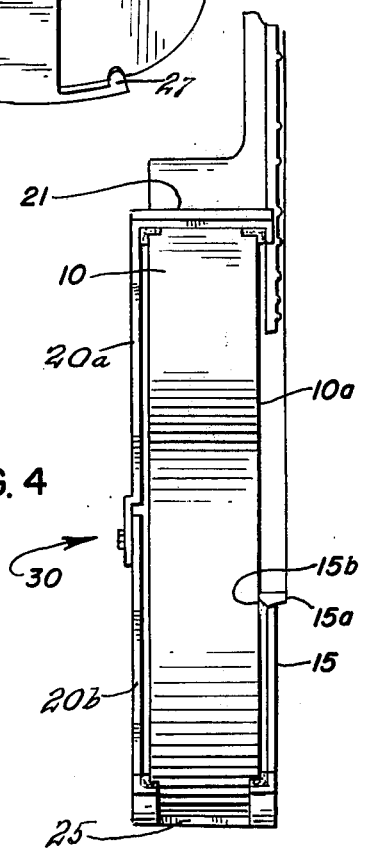
FIG. 4 is an edge view of the guitar body from the left-hand side of FIG. 2.
Figure 5:
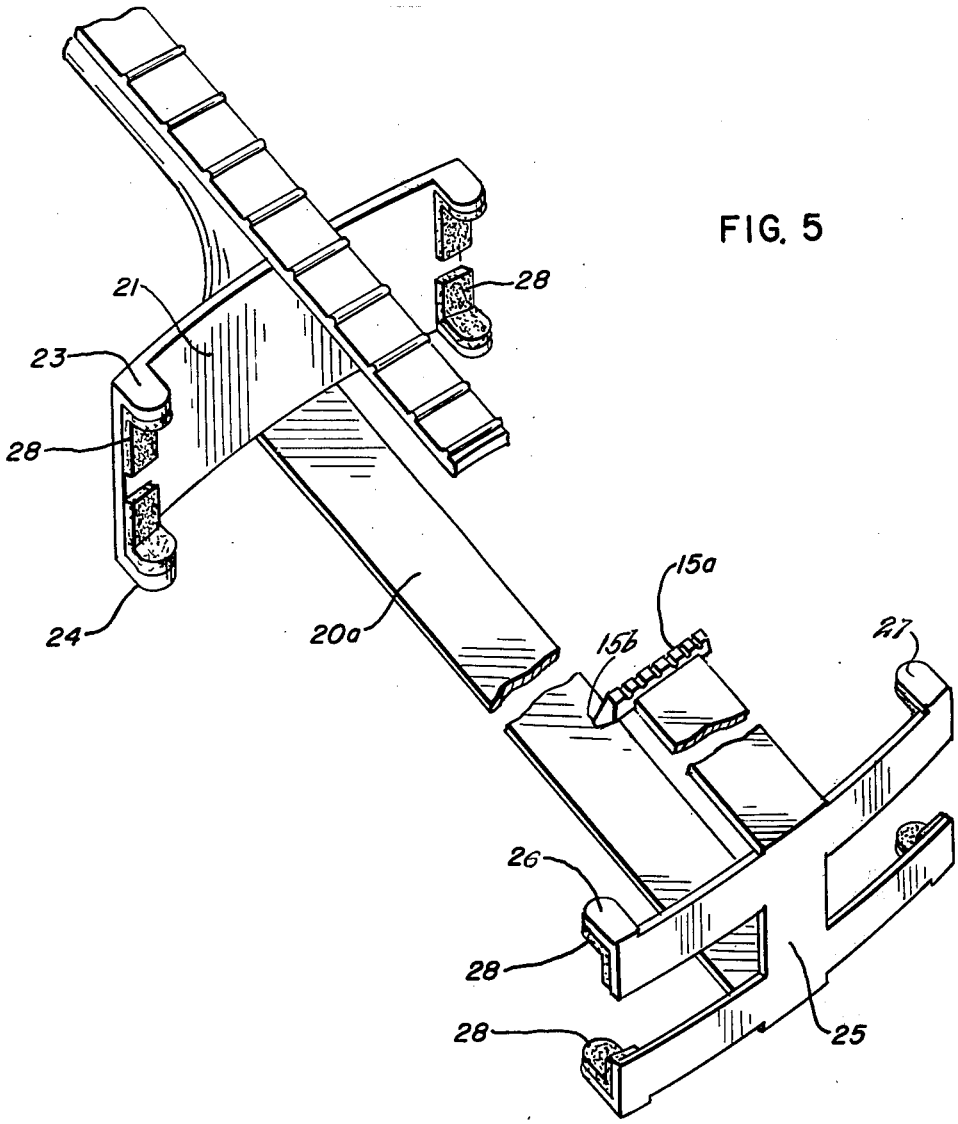
FIG. 5 is a perspective view of the frame on a larger scale, showing it combined with an instrument fret board.

Referring specifically to the drawing, 10 denotes the body of the guitar. Its top is the sound board 102 and considered as the main vibrating element to pass the sound of the strings to the opening **10*b* in the sound board. The standard bridge—not shown—is also considered as passing vibrations to the sound board 10*a*** from the pressure of the strings.

As mentioned before, the present invention does away with the standard bridge, for the reasons explained, and substitutes a frame extended with a tail piece 15 over the wider portion of the sound board wall **10*a*. The tail piece is a metal plate whose inner end is formed with an upward receptacle 15*a* for the inner ends of the strings and a thin downward cross-rib 15*b* engaging the outer side of the sound board 10*a*** as a bridge.

The tail piece 15 is a part of a solid frame in which the body 10 is floatingly supported. The base of the frame extends longitudinally under the guitar body 10 as a linear assembly of bars **20*a* and 20*b* extending the length of the guitar body. Opposite the narrower portion thereof the bar 20*a* is bent up with a cross-piece 21 which is bowed like the related end of the guitar body. At the ends the cross-piece 21 is extended from its top and bottom edges with return clips 23 and 24 over the top and bottom corners of the guitar body. The bar 20*b* is similarly extended with a cross-piece 25 and upper and lower return clips 26 and 27. However, this cross-piece also extends inwardly with the tail piece 15. It may now be pointed out that the interiors of all the clips are fitted with angle-inserts 28** of semi-hard rubber in order to separate the metallic clips from the wooden body of the guitar, and secure the same floatingly in the frame.

Since guitars of the same size may differ slightly in body length, the frame is adjustable to fit by making the bars **20*a* 20*b* with a lap-joint 30 at a medial point, with screws 31 directed through longitudinally-extending slots 32 in one bar to thread into tapped hole 33** made in the other. While the lap-joint is shown exaggerated in the drawing for purposes of clarity, it would of course be inconspicuous in practice. Also, a different type of length-adjustment may be substituted.

It is now apparent that in the present invention the frame is in one piece with the fret or string board of the instrument. It is further apparent that the present frame is an attachment which is inconspicuous because it is mostly located in back of the guitar. The frame and its formations follow the form and curves of the guitar body, but it is slightly spaced from it at all points except the bridge **15*b*. However, the latter is thin across and in firm engagement with the sound board of the guitar body for the transmission of sound vibrations, while the strong pull of the strings is on the tail piece 15 which is a rigid part of the frame and apart from the guitar body 10**. The frame is therefore a receptacle for the latter which frees its entire top for vibrations emitted by the strings or transmitted by the bridge, while relieving the sound board and body of strain from the pull of the strings. Finally, it is apparent that the present frame is also applicable to violins, violincellos and other string instruments to improve their tonal qualities.

I claim:

1. A stringed musical instrument, comprising:

a body comprising a top soundboard, a bottom soundboard, and side member means connecting said soundboards to form a resonant chamber within said body, said soundboards having no supporting braces connected thereto;

a frame mounted externally of said body for floatingly supporting said body, said frame comprising a neck, a tailpiece, and bar means rigidly connecting said neck and tailpiece; means contacting said body substantially along the edges of said soundboards for floatingly supporting said body above said bar means; and strings connected to said neck and tailpiece, the tension of said strings being resisted solely by said frame.

2. The stringed instrument of claim 1, further comprising a bridge formed integrally with said tailpiece, said tailpiece and bridge comprising an extension of said frame above said top soundboard, an upwardly directed receptacle for receiving said strings and a downwardly directed cross-rib serving as said bridge.

3. The stringed instrument of claim 1, further comprising means for adjusting the length of said bar means to permit said frame to fit bodies of various lengths.

4. The stringed instrument of claim 1, wherein said body contacting means comprises extensions from said bar means spanning the width of the sides of said body at the neck end and the tailpiece end of said body, respectively, said extensions having clips thereon for gripping said body.

5. The stringed instrument of claim 4 wherein said clips have semi-hard inserts fitted thereto to securely grip said body and to protect the body from being marred by said clips.

6. The stringed instrument of claim 1 wherein said body is the body of a guitar.

* * * * *